United States Patent [19]

Schmidlin

[11] 4,111,127

[45] Sep. 5, 1978

[54] CENTRIFUGAL ROLLING BALL LOCKING DEVICE

[75] Inventor: Albertus E. Schmidlin, Caldwell, N.J.

[73] Assignee: The United States of America as represented by the Secretary of the Army, Washington, D.C.

[21] Appl. No.: 825,887

[22] Filed: Aug. 19, 1977

[51] Int. Cl.[2] ..... F42C 15/22

[52] U.S. Cl. ..... 102/237; 74/2

[58] Field of Search ..... 102/79, 70 R; 74/2, 74/567; 192/105 B

[56] References Cited

U.S. PATENT DOCUMENTS

| | | | |
|---|---|---|---|
| 2,306,696 | 12/1942 | Hale | 192/105 B |
| 2,733,659 | 2/1956 | Booth | 102/79 |
| 2,775,665 | 12/1956 | Harstick | 200/80 |
| 3,270,670 | 9/1966 | Guerne | 102/79 |
| 3,762,519 | 10/1973 | Bentley | 192/105 B |

*Primary Examiner*—David H. Brown

*Attorney, Agent, or Firm*—Nathan Edelberg; A. Victor Erkkila; Max Yarmovsky

[57] ABSTRACT

A pair of contacting rolling spheres are disposed in a tubular housing intermediate a stationary cam element and a fluidically damped and lubricated movable cam-piston member. The cam-piston member provides an axial force of sufficient strength to restrain loosely stacked elements of a spin stabilized munition. The device has its longitudinal axis offset from the main spin axis of the munition in order to utilize centrifugal forces associated with spin to generate by cam action an axial thrust force of sufficient magnitude and proper direction to restrain slidable elements within the munition.

6 Claims, 4 Drawing Figures

CENTRIFUGAL ROLLING BALL LOCKING DEVICE

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art fabrication of projectiles to hold the internal elements of a projectile, such as the fuze section and the warhead charge, in abutment with each other. Decrease of space between elements is necessary in order to avoid inertially induced shock effects caused by launching set back forces. Prior art projectiles in some instances have experienced malfunctions causing injury to launch personnel as a result of unwanted movement of internal parts. Generally during fabrication of a projectile the internal parts are sequentially inserted into a shell and held together by a base member. The base structure frequently comprises a threaded base member which is screwed into the back of the shell having a spring system disposed intermediate the base member and the warhead charge and or the fuze elements. A compressed spring frequently is used to help axially preload the internal parts and to operatively position any loose internal parts during stockpile to target transportation sequence. The problem with prior art devices utilizing base members with intermediate helical springs has been the inability of such apparatus to provide sufficient axial loading under high stress environments within the material capabilities of the helical spring and within the space limitations provided in the shell.

PRIOR ART STATEMENT

The applicant has reviewed U.S. Pat. No. 2,775,665 of W. H. Harstick and found it of interest and to a limited extent pertinent to the present application. The aforementioned patent discloses, in FIG. 1, a centrifugally actuated speed governor comprising a stationary insert cam member 34, an actuating cam member 21 in abutment therewith, a plurality of first spherical members 37 in engagement with the insert cam member 34 and a plurality of second spherical members 38 in engagement with the actuating cam member 21, the first spherical members 37 being in engagement with the second spherical members 38, the first and second spherical members being movable laterally on the cam members in response to centrifugal force thereby urging the actuating member 21 to move in an axial direction. The present invention may be distinguished from U.S. Pat. No. 2,775,665 in that the latter device requires a helical spring 36 having the undesirable strength limitations aforementioned, for keeping the cam elements in abutment with one another. In addition, the prior art rather than having its longitudinal axis offset teaches the use of an axially aligned drive means 14. An axially aligned arrangement for the specific embodiment of the present rolling ball locking device hereinafter described in FIG. 1, would result in making the present device not capable of functioning under the influence of projectile spin.

SUMMARY OF THE INVENTION

The present invention relates to a centrifugal rolling ball device comprising a fluidically damped and fluidically lubricated movable cam-piston member. The present apparatus pre-loads the internal elements of a projectile and exerts an axial force thereon sufficient to overcome the inertial effects encountered as a result of transportation or launching acceleration environments.

An object of the present invention is to provide a centrifugal rolling ball fluidically damped locking device for a spinning projectile which is capable of producing axial loads larger than produced by a helical spin without exceeding the space provide therein for the conventional helical spring.

Another object of the present invention is to provide a centrifugal rolling fluidically damped ball locking device for the internal parts of a spinning projectile wherein the locking device can produce larger axial loads than a take-up helical spring which it replaces, having the same space limitations and which is lighter in weight than the spring.

Another object of the present invention is to provide a centrifugal rolling ball fluidically damped locking device for the internal parts of a spinning projectile which is interchangeable with the helical take-up springs to permit field modification without rework of projectile metal parts.

A further object of the present invention is to provide a centrifugal rolling ball fluidically damped locking device for keeping the internal sliding parts of a spinning projectile in abutment with each other by maintaining high load capability during firing of the projectile without the necessity of requiring a high preload compression force during assembly.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
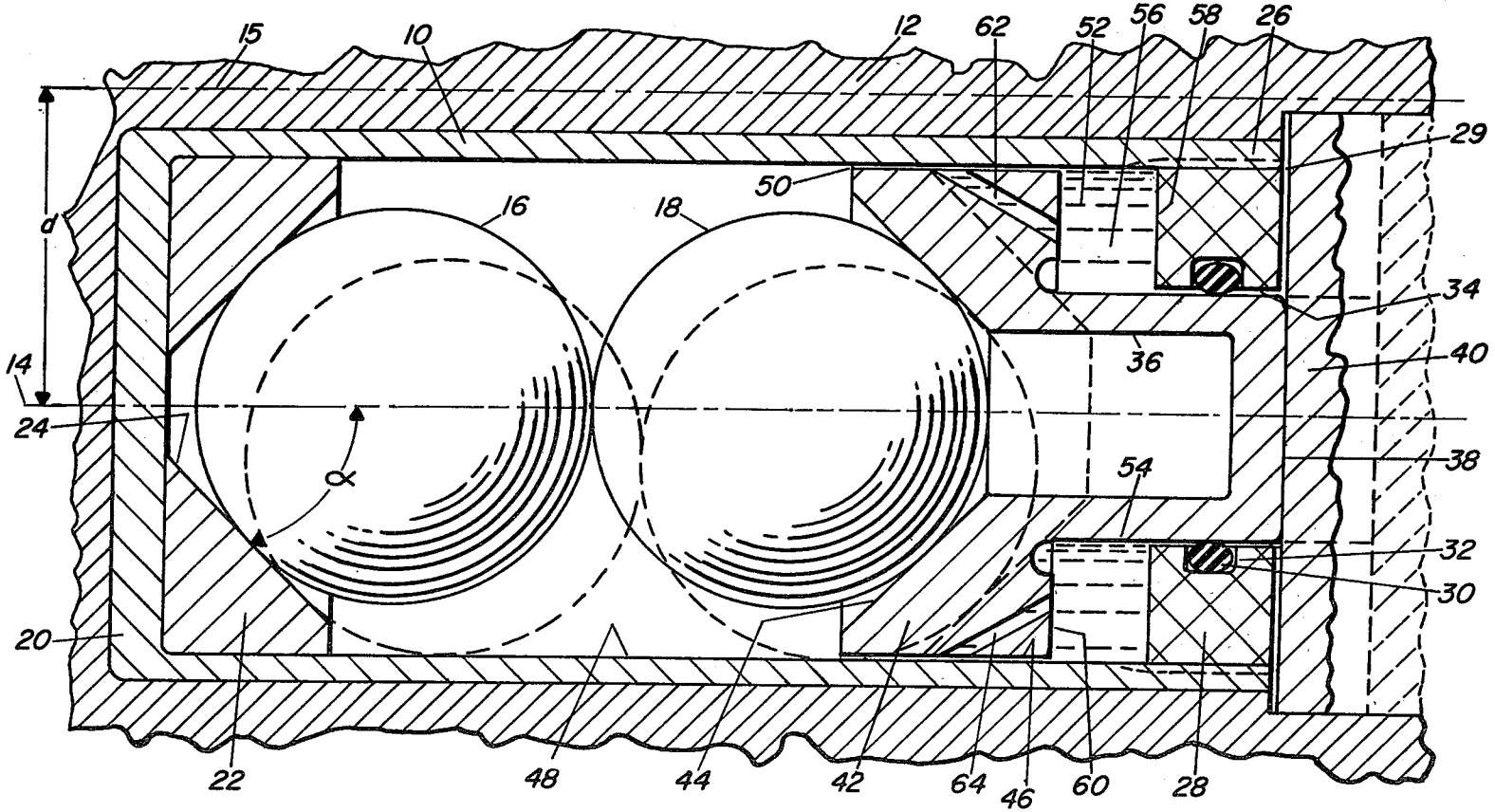
FIG. 1 is a longitudinal partial cross-sectional view of an embodiment of the invention.

Referring now to FIG. 1 a cup shaped housing 10 is fixedly positioned in a projectile 12 so that the housing longitudinal axis 14 is parallel to the principal longitudinal axis 15 of projectile 12 and off set therefrom by a distance "*d*" so that a pair of rolling spherical members 16 and 18 are subjected to a centrifugal force induced by the spin of the projectile 12. The closed end 20 of housing 10 is engaged in abutment with a stationary cone shaped cam insert 22. Cam insert 22 has an outwardly divergent seat surface 24 therein which is in annular line contact with the first spherical rolling member 16. The internally threaded open end 26 of housing 10 has an annular externally threaded sealing member 28 screwedly attached thereto. An "O" ring 30 is operatively positioned in annular "O" ring grooved 32 annularly located in a central bore 34. A piston-cam-plunger member 36 is slidably disposed in housing 10 and has a tubular stem section that passes through the central plunger stem bore 34 of sealing member 28 and whose peripheral surface is in contact with "O" ring 30. The front stem end 38 of piston-cam plunger member 36 is in abutment with an internal movable projectile member 40 of projectile 12 that is restrained from rearward motion normally occurring during projectile launch as a result of setback forces. The tubularly shaped rear end 42 of piston-cam plunger 36 has a second cone shaped outwardly divergent interior cam seat surface 44 axially positioned therein. The exterior cylindrically shaped wall 46 of tubular cam rear end 42 is in slidable contact with the interior wall surface 48 of housing 10 and is separated therefrom by a clearance space 50. The outwardly divergent ramp surface 44 is oppositely disposed from the first cam insert ramp seat surface 24. A damping fluid 52, such as Dow Corning Fluid No. 332 manufactured by Dow Corning Corp., of Midlan Michigan, or a damping grease such as Versilube G-351 as manufactured by General Elec Co., Chem. Div, Pittsfield, Mass., is disposed around the piston stem exterior wall 54 in annular volume 56 intermediate the front end 58 of sealing member 28 and a shoulder section 60 of piston-cam plunger tubular rear end 42. A pair of diametrically disposed lubrication passageways 62 and 64 are operatively positioned in plunger rear end 42 so that one orifice end of each passageway communicates with annular volume 56 and their other orifice ends communicate with clearance space 50.

Figure 2:
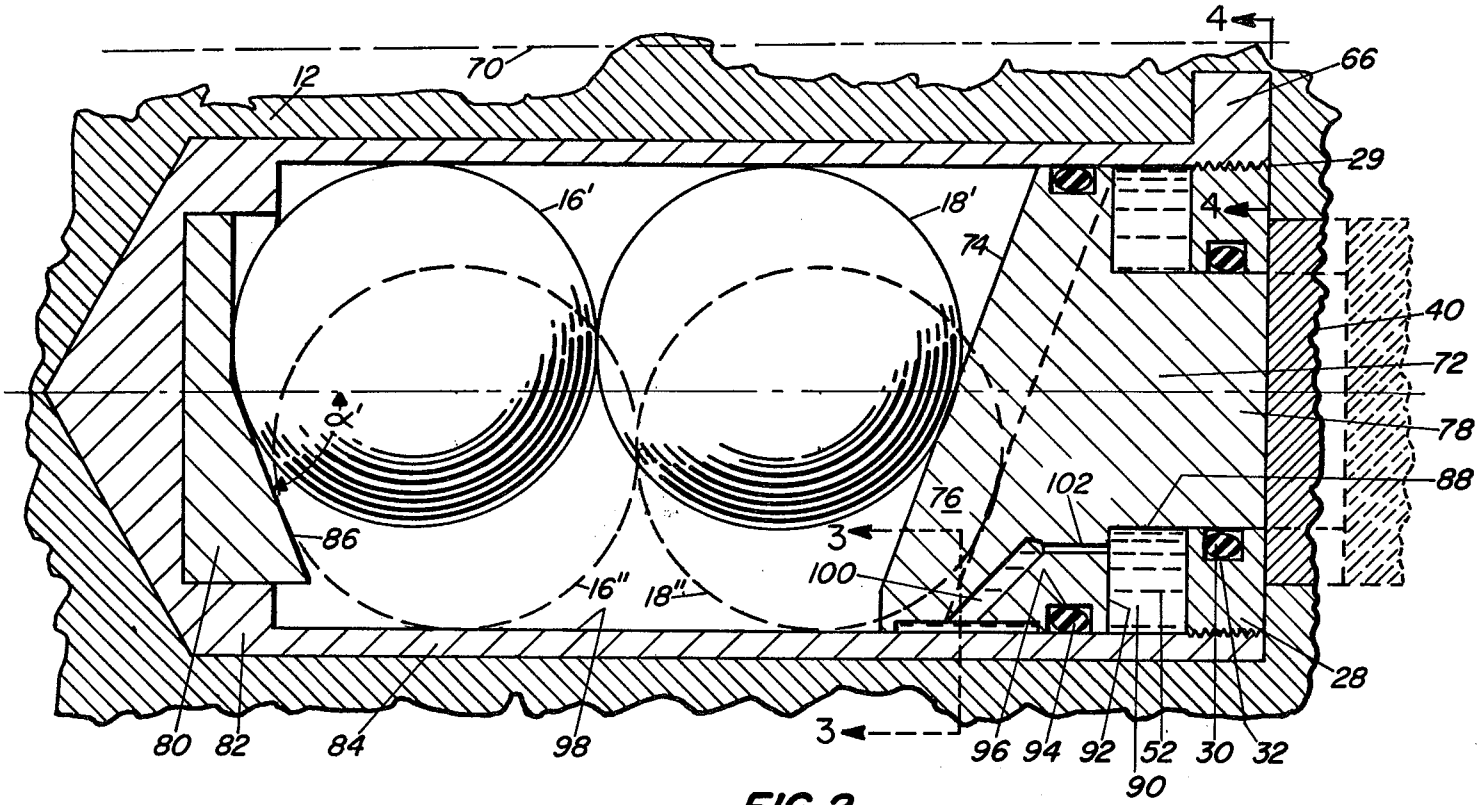
FIG. 2 is a longitudinal partial cross-sectional view of an alternative embodiment of the invention.
Figure 4:
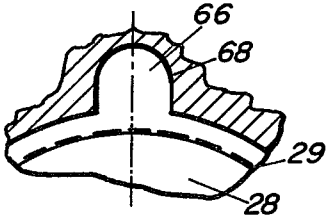
FIG. 4 is a partial cutaway view taken along line 4—4 of FIG. 2.
Figure 3:
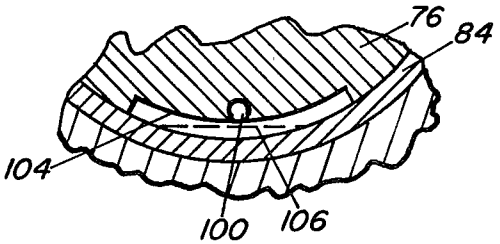
FIG. 3 is a partial cross-sectional view of the alternative embodiment taken along line 3—3 of FIG. 2.

Referring now to FIGS. 2–4, an alternative embodiment of the device shown in FIG. 1 is illustrated. This device may be used in projectile applications requiring greater axial thrust force from essentially the same size locking unit. Greater axial thrust force is accomplished in this preferred embodiment by modifying the cone or cam angle "$\alpha$". FIG. 2 shown an example of a design where the angle $\alpha'$ has been increased thus increasing the force potential, without incurring the disadvantage of decreasing the total amount of plunger travel. Normally changing the cone angle alone will increase the force potential at the expense of the total travel of the piston-cam plunger. In order to remain within the same space limitations, a ramp angle which produces twice as much force must necessarily provide a travel of only one half the previous amount of travel. The limitation is overcome in the present alternate embodiment of the invention with an unidirectional design shown in FIG. 2, rather than the omnidirectional design of FIG. 1. FIG. 2, which as a ramp angle "$\alpha'''$ greater than angle "$\alpha$", illustrates a device which provides twice the axial force of the device shown in FIG. 1 with the same amount of plunger travel. The basic difference between the design illustrated in FIG. 1 and FIG. 2 is that in the latter design the rolling spherical members 16' and 18' have twice as much potential radial movement from the initial to final position as shown in dash lines by the position of spherical members 16'' and 18''. To accomplish this, the device illustrated in FIG. 2 must be oriented in a specific direction in order to properly operate. The latter device must be oriented within the spinning projectile 12 so that the centrifugal force acts in a proper direction. An index tab 66 protrudes from the peripheral edge of the housing open end and is operatively positioned to engage a keyslot 68 disposed in the base of the projectile 12. Tab 66 is oriented to point toward the longitudinal centerline 70 of the projectile 12. A piston cam-plunger member 72 has a flat inclined ramp surface 74, on piston cam-plunger cylindrically shaped rear end 76, which is in abutment with second spherical member 18'. A tubular stem front end 78 of piston cam-plunger 72 is in contact with the projectile movable internal member 40. A stationary inclined plane shaped cam-insert 80 is disposed in the rear end 82 of cup shaped housing 84. Stationary cam-insert 80 has a flat inclined ramp surface 86 thereon which is in point contact with the first spherically shaped member 16'. The ramp surfaces 74 and 86 are oriented with respect to each other to diverge in a direction toward centerline 70 and to converge in direction followed by spherical members 16' and 18' when acted upon by the centrifugal forces of spin. A damping and lubricating fluid 52 is operatively disposed around the piston stem cylindrical surface 88 in a reservoir annular volume 90 which is located intermediate externally threaded annular sealing member 28 and shoulder section 92 of plunger rear end 76. A first "O" ring 30 is operatively disposed in sealing member "O" ring groove 32. A plunger "O" ring 94 is operatively disposed in plunger "O" ring annular groove 96 peripherally located in the plunger rear end 76. "O" ring 94 forms a fluid seal between the plunger 72 and the interior housing wall 98. Reservoir 90 communicates with lube passageway 100 through flow control bore 102. A semicircular shaped lube slot 104, peripherally disposed in plunger rear end 76, permits damping fluid 52 to act as a hydrostatic lubrication pad between plunger 72 and interior housing wall 98 to minimize friction due to the centrifugal side force on the plunger 72 created by spin.

In operation, the embodiments shown in FIGS. 1 and 2 are mounted so that their longitudinal axes are parallel to the principal axes 15 and 70 respectively of a projectile 12 and displaced there from so that the spherical members 16 and 18, and 16' and 18' are subjected to a centrifugal force as the projectile 12 spins. Under the action of centrifugal force balls 16, 18 and 16', 18' move downwardly away from the projectile principal axis and the piston-cam plunger elements move toward the projectiles' internal member 40 thereby producing an axial force on movable member 40. In both designs, the amount of free, no-load travel of piston cam-plungers members 36 and 72, no-load travel of the plungers and internal member 40 is variable depending upon the application and the dimensional tolerances in the piece parts involved. In order to preclude sudden shock impact between internal elements of the projectile, for the case of a large amount of free travel, fluid damping is used. Damping fluid 52 is compressed as the plungers 36 and 72 move rearwardly due to setback forces. The fluid 52 is forced by plungers 36 and 72 to flow toward regions of lesser pressure. Leakage of fluid in the designs of FIGS. 1 and 2 around the stem of the plunger is prevented by "O" ring seal 30 and at the thread by a thread sealant not shown, applied at circular joint 29.

In the FIG. 1 design, damping fluid 52 flows from the annular volume reservoir 56 through passageway 62 and thence through clearance space 50 located between piston-cam plunger rear end 42 and the interior wall 48 of housing 10. This action provides, in addition to damping, lubrication for the piston-cam plunger member 36, reducing friction, and improving the efficiency of the device. Distribution of the damping fluid-lubricant 52 is enhanced by lube passageway 62.

During operation, the rotation of the projectile creates a high centrifugal force and potentially high friction between the housing 10 and the piston-cam plunger 72. For the embodiment shown in FIG. 2 friction force is minimized and substantially eliminated for all practical purposes.

In the FIG. 2 embodiment of the invention the damping fluid 52 is prevented from flowing freely under pressure by the "O" rings 30 and 94. The damping fluid 52 in this instance is supplied instead to the region of maximum loading, in the semi-circular area of slot 104 of piston-cam-plunger 72. The maximum side load on the piston-cam-plunger member 72 occurs in the region taken along line 3—3 of FIG. 2. Fluid 52 is supplied to this area through lube passageway 100 and flow control bore 102. The flow bore 102 controls the flow rate and thereby the piston-cam-plunger 72 velocity. In this design all of the fluid 52 is supplied to this area and the pressure serves to float the piston-cam-plunger 72 on a liquid film 106, thus minimizes sliding friction. Friction in both designs is substantially reduced at the moving surfaces by the use of a plurality of spherical members 16, 18 and 16', 18' which because of their rolling action rather than sliding contact produce sufficient axial thrust and make more efficient use of the potential energy of the balls in the centrifugal force field.

The dashed lines in FIGS. 1 and 2 show the final position of the rolling balls and the piston-cam-plunger after they have been actuated by the spin launched projectile.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A centrifugal rolling-ball, fluidically damped, locking device for restraining loosely stacked elements contained within a spin stabilized projectile which comprises;

a cup shaped housing operatively disposed in said projectile so that a longitudinal axis of said housing is disposed parallel to the principal longitudinal axis of said projectile and offset therefrom by a distance "*d*", said housing having a closed end and an internally threaded open end;

stationary ramp means fixedly positioned in said closed end of said housing for providing a first caming surface at said closed end of said housing;

a first spherical member disposed within said housing and in contact with said stationary ramp means, said first spherical member being inertially responsive to the centrifugal force of spin of said projectile;

a second spherical member operatively positioned within said housing and in rolling point contact with said first spherical member, said second spherical member being inertially responsive to the centrifugal force of spin of said projectile;

piston-cam-plunger means, slidably disposed in said housing in abutment with said second spherical member, for providing an axial force to restrain said loosely stacked elements of said projectile during projectile launch, said second spherical member being in rolling contact with said piston-cam-plunger means;

sealing member means screwedly attached to the internally threaded open end of said housing, said sealing member means having a central plunger stem bore therein adapted for slidable passage of said piston-cam-plunger means therethrough, said sealing member means and said piston-cam-plunger means being separated by an annular reservoir volume; and damping fluid means operatively disposed in said annular reservoir volume for limiting shock impact to said loosely stacked elements of said projectile during projectile launch and for lubricating said piston-cam-plunger means when said piston-cam-plunger means is linearly moved within said housing by said second spherical member in response to the centrifugal force of spin of said projectile.

2. A centrifugal rolling-ball, fluidically damped, locking device as recited in claim 1 wherein said stationary ramp means comprises a cone shaped cam insert having an outwardly divergent ramp surface that is inclined at an angle "$\alpha$" with respect to the longitudinal axis of said cup shaped housing.

3. A centrifugal rolling-ball, fluidically damped, locking device as recited in claim 1 wherein said stationary ramp means includes an inclined plane shaped cam-insert, the surface of said inclined plane being outwardly divergent from the longitudinal axis of said cup shaped housing by an angle "$\alpha'$".

4. A centrifugal rolling-ball, fluidically damped locking device as recited in claim 2 wherein said piston-cam-plunger means comprises a piston-cam-plunger member having a tubularly shaped stem which slidably passes through the central bore of said sealing member means and having a front stem end in abutment with said stacked elements of said projectile, a tubularly shaped cam rear end having a cone shaped interior cam seat surface axially positioned therein and an exterior cylindrically shaped wall in slidable contact with an interior wall surface of said housing and separated therefrom by a clearance space and a shoulder section thereon, and a pair of diametrically disposed lubrication passageways each having end orifices which communicate with said clearance space and other end orifices which communicate with said annular reservoir volume.

5. A centrifugal rolling-ball-fluidically damped locking device as recited in claim 3 wherein said piston-cam-plunger means comprises a piston-cam-plunger member having a flat inclined ramp surface operatively disposed on a cylindrically shaped rear end, said flat inclined ramp surface being in abutment with said second spherical member, a tubular stem section having a front end in contact with said movable internal member of said projectile, said tubular stem section slidably passes through the central bore of said sealing member means, said flat inclined ramp surface of said plunger member and said stationary ramp means oriented with respect to each other to diverge in a direction toward the longitudinal axis of said projectile and to converge in a direction followed by said first and second spherical members when acted upon by the centrifugal forces of spin, said rear end of said piston-cam-plunger having a plunger "O" ring groove peripherially located therein and a plunger "O" ring operatively disposed therein forming a fluid seal between said plunger rear end and the interior wall of said housing, said plunger rear end having a semi-circularly shaped lube slot peripherally disposed therein which communicates with said annular reservoir volume via a lube passageway and a connecting fluid control bore, said lube slot forming a liquid film for substantially reducing friction between said piston-cam-plunger member and said housing interior wall at a maximum region of load.

6. A centrifugal rolling-ball, fluidically damped locking device as recited in claim 5 wherein said cup shaped housing has a housing index tab protruding from peripheral edge of said open end, said index tab being disposed in a keyslot in said projectile to orient said locking device to be operatively responsive to the centrifugal force of projectile spin.

* * * * *